US005277718A

United States Patent [19]

Paxson et al.

[11] Patent Number: 5,277,718

[45] Date of Patent: Jan. 11, 1994

[54] TITANIUM ARTICLE HAVING IMPROVED RESPONSE TO ULTRASONIC INSPECTION, AND METHOD THEREFOR

[75] Inventors: Allen J. Paxson; Clifford E. Shamblen, both of Cincinnati, Ohio

[73] Assignee: General Electric Company, Cincinnati, Ohio

[21] Appl. No.: 920,231

[22] Filed: Jun. 18, 1992

[51] Int. Cl.[5] ..... C22F 1/00

[52] U.S. Cl. ..... 148/671; 148/417; 148/421; 148/670

[58] Field of Search ..... 148/670, 671, 417, 421

[56] References Cited

U.S. PATENT DOCUMENTS 3,470,034 9/1969 Kastanek et al. ..... 148/670

4,799,975 1/1989 Ouchi et al. ..... 148/671

4,854,977 8/1989 Alheritiere et al. ..... 148/671

5,026,520 6/1991 Bhowal et al. ..... 148/670

5,173,134 12/1992 Chakrabarti et al. ..... 148/671

*Primary Examiner*—Upendra Roy

*Attorney, Agent, or Firm*—Jerome C. Squillaro; Carmen Santa Maria

[57] ABSTRACT

A titanium alloy billet having improved response to ultrasonic inspection is described. The billet is given a thermomechanical treatment above the beta transus of the alloy immediately prior to ultrasonic inspection. The treatment may include beta annealing or mechanical deformation above the beta transus. The invention is particularly effective for beta-stabilized alpha-beta and beta titanium alloys.

6 Claims, 3 Drawing Sheets (PRIOR ART PROCESS)

TITANIUM ARTICLE HAVING IMPROVED RESPONSE TO ULTRASONIC INSPECTION, AND METHOD THEREFOR

This invention relates to modifications in the processing of titanium alloy billets, with the result that billets so processed exhibit improved response to ultrasonic inspection.

BACKGROUND OF THE INVENTION

Titanium alloys are widely used in the aerospace industry because they provide a useful combination of low density, high strength, good toughness, good resistance to corrosion and oxidation, and the ability to retain these properties at temperatures up to about 950° F. However, the nature of aerospace vehicles and propulsion systems, where unnecessary weight exacts a penalty in reduced payload or fuel economy, indicates that designers of such vehicles and systems often seek to load the materials used therein as near to their performance limits as is reasonably prudent. Doing so requires that aerospace materials be made with special care, including careful inspection, to ensure that sound material be used in such a vehicle or system.

Ultrasonic inspection is widely used to inspect nonferrous alloys for aerospace applications. The inspection may be done on semifinished mill products, such as billets, and again on forgings made from those mill products. The double inspection has generally been justified on the basis that the inspection of billets does not detect all of the material imperfections, even those which originate in the manufacture of ingots. However, if ultrasonic inspection of billets could be made more sensitive, it might be possible to omit the second inspection. Besides eliminating the cost of the second inspection operation, imperfections would be identified and removed from the manufacturing process before the cost of forging is incurred; thus, the concept of relying on ultrasonic inspection solely at the billet stage is economically attractive. All metals contain imperfections, which are inherent in their formation. Some imperfections are larger than others with small imperfections not being capable of detection. The smallest size capable of being detected is referred to as the minimum resolvable size.

Ultrasonic inspection is affected by two intrinsic characteristics of the material being inspected, namely, attenuation of the sound waves and reflection of the sound waves within the material itself. Attenuation is manifested as weakness of any signals generated in response to internal structure and imperfections in the material due to scattering of the signal. Reflections from internal structural features as grain boundaries are manifested as noise, which are sometimes referred to as "grass" in the electronic image of the ultrasonic inspection, while reflections from imperfections are frequently referred to as indications. Unfortunately, most titanium alloys suffer from both high attenuation and high noise levels. Consequently, it is difficult to distinguish valid ultrasonic reflections indicating the presence of a subsurface indication from noise, particularly in large diameter billets where the indication may be as much as seven or eight inches below the surface. In comparison, other alloy families, such as aluminum-, iron- and nickel-base alloys, permit much more sensitive ultrasonic inspection than do titanium alloys.

Several investigators have attempted to determine the cause for the high attenuation and high noise in ultrasonic inspection of titanium alloys, specifically Ti-6Al-4V (Ti-64), which is a widely used alpha-beta alloy. Billman and Rudolph ("Effects of Ti-6Al-4V Metallurgical Structure on Ultrasonic Response Characteristics," *Titanium Science and Technology*, edited by Jaffe and Burte, Vol. 1, (1973), pp. 693–70.5, Plenum Press, New York) evaluated ultrasonic inspection behavior of Ti-64, as such behavior is affected by macrostructure and microstructure, and by deformation below the beta transus. They pointed out the importance of refining the alpha platelets in the microstructure, which they were able to accomplish by beta recrystallization at 2000° F. and by extensive deformation below the beta transus. The beta transus of a titanium alloy is that temperature above which the alpha phase does not exist at equilibrium conditions.

Allison, Russo, Seagle and Williams ("The Effect of Microstructure on the Ultrasonic Attenuation Characteristics of Ti-6Al-4V, "*Titanium Science and Technology*, edited by Lutjering, Zwicker and Bunk, Vol. 2, (1985), pp. 909–916, Deutsche Gesellschaft fur Metallkunde) showed the value of quenching from a temperature above the beta transus to reduce ultrasonic attenuation in Ti-64.

Granville and Taylor ("High Noise Levels during the Ultrasonic Testing of Titanium Alloys," British Journal of NDT, May, 1985, pp. 156–158) point out the importance of the shape and distribution of alpha particles in determining alloy behavior during ultrasonic inspection.

U.S. Pat. No. 3,470,034, the disclosure of which is incorporated herein by reference, teaches refinement of the microstructure by deformation starting above and ending below the beta transus as a means for reducing noise in ultrasonic inspection.

U.S. Pat. No. 3,489,617, the disclosure of which is incorporated herein by reference, teaches the deformation and beta recrystallization for breaking up alpha networks at prior beta grain boundaries to achieve a better combination of ductility and strength. Both of these patents are directed to Ti-64

As indicated hereinabove, prior work has been directed toward Ti-64 and related alloys; titanium alloys containing greater amounts of the beta stabilizing alloying elements have not received nearly as much attention. Titanium alloys . containing large amounts of beta stabilizing alloying elements are often identified as beta-stabilized alpha-beta alloys, or beta alloys.

The present invention is directed toward a need for improving the ultrasonic response of beta-stabilized alpha-beta and beta titanium alloys. Such alloys respond differently to thermal and deformation processing, and to ultrasonic inspection, than do the alpha alloys and alpha-beta alloys such as Ti-64. Therefore, the methods used to improve the response of alpha and alpha-beta alloys are not capable of providing similar improved response for the beta and beta-stabilized titanium alloys.

SUMMARY OF THE INVENTION

The present invention provides a titanium alloy billet having improved response to ultrasonic inspection. The method of the present invention includes a specific thermomechanical treatment which is applied to the billet preceding ultrasonic inspection. The thermomechanical treatment may include annealing above the beta transus temperature of the alloy, it may include mechanical deformation above the beta transus, or it may include a combination of mechanical deformation and thermal treatment above the beta transus, to yield a beta or beta-stabilized alpha-beta titanium alloy (hereinafter referred to as a beta titanium alloy).

The term beta recrystallizing is used herein to indicate any of several types of thermomechanical treatment of the present invention which result in beta recrystallization. After such beta recrystallizing and subsequent cooling, the grain size is reduced and the structure of the alloy is substantially free of texture. Also, flow lines indicative of metal flow during forging or rolling do not appear after macroetching. The resulting structure significantly reduces the reflection of ultrasonic waves within the metal, which may be called noise, with the result that reflections of ultrasonic waves from material imperfections are more readily distinguished from the noise. In terms of the effectiveness of the inspection, the present invention provides increased confidence that an imperfection in the billet will be detected by ultrasonic inspection, and it also effectively reduces the minimum resolvable size.

The operation and advantages of the present invention are described in greater detail in the drawings and detailed description which follow.

DETAILED DESCRIPTION OF THE INVENTION

The present invention has been developed to provide titanium alloy billets, particularly billets of beta titanium alloys, that provide improved response to ultrasonic inspection. Such improved response to ultrasonic inspection means that confidence that an imperfection in the billet will be detected by ultrasonic inspection is likewise improved, thus effectively reducing the minimum resolvable size.

The improved response to ultrasonic inspection described herein is achieved through processing the billet in such a way as to obtain a substantially equiaxed and substantially randomly oriented fine grain prior beta grain structure.

Figure 1:
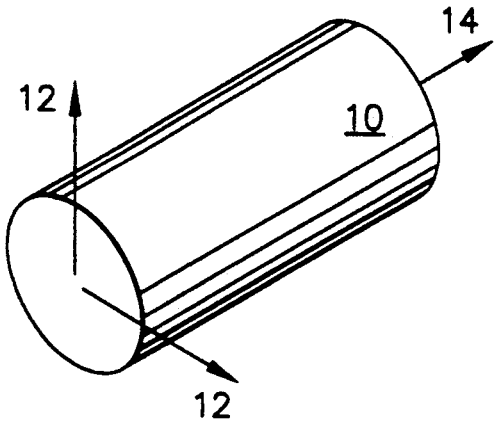
FIG. 1 is a perspective view of a cylindrical billet, illustrating radial and axial directions.

FIG. 1 illustrates a section of a billet of the type contemplated in the present invention. Billets produced for the aircraft gas turbine industry may have diameters as large as 16 inches, although, in general, billets are made in smaller diameters, consistent with the size of the part to be forged from the billet. The length of a billet may exceed 15 feet.

Ultrasonic inspection of titanium alloy articles at the billet stage is preferable to inspection of forgings subsequently made from those billets for several reasons. First, detection of resolvable imperfections at the billet state means that material containing such imperfections can be eliminated from the production process without incurring the expense of forging and other manufacturing operations which might be performed before the imperfections are otherwise detected. Second, the complexity of forged shapes sometimes makes thorough ultrasonic inspection difficult or impossible. Third, a forging must be machined all over to obtain a surface amenable to ultrasonic inspection. Finally, the forging process is typically designed to produce a metallurgical structure that provides a combination of mechanical properties that is well suited to the use of the forged part; such a structure is not necessarily sensitive to ultrasonic inspection. Although the concept of ultrasonic inspection of titanium alloy billets prior to forging is very attractive, it has heretofore been difficult to perform such inspection with sufficient sensitivity that otherwise resolvable imperfections could be reliably detected.

As indicated previously, titanium alloys typically present severe obstacles to high-sensitivity ultrasonic inspection, namely, high attenuation and high scattering, resulting in reduction in amplitude of the ultrasonic signal and high noise levels. These characteristics, plus the large billet size necessitated by the size of forged parts common in the aircraft industry, have precluded effective ultrasonic inspection at the billet stage.

During development of the present invention it was recognized that it is not always possible or convenient to change the billet size, so the most promising avenue for more effective ultrasonic inspection of a titanium alloy billet is to change the processing schedule to provide a metallurgical structure in the billet that reduces the scattering, attenuation and noise levels characteristic of titanium alloy billets. It was also recognized that the only significant ultrasonic inspection for this purpose would necessarily be made in the radial direction 12 of a titanium alloy billet 10, illustrated in FIG. 1. Improvement in ultrasonic inspection behavior in the axial direction 14 is considered relatively unimportant because of the great length of a billet compared to its diameter. The identification of inspection directions in the literature is not always clear, but what is referred to as the longitudinal direction is equivalent to the axial direction 14, and what is referred to as the transverse direction is equivalent to the radial direction 12. The terms radial and axial are used herein to avoid ambiguity.

Figure 2:
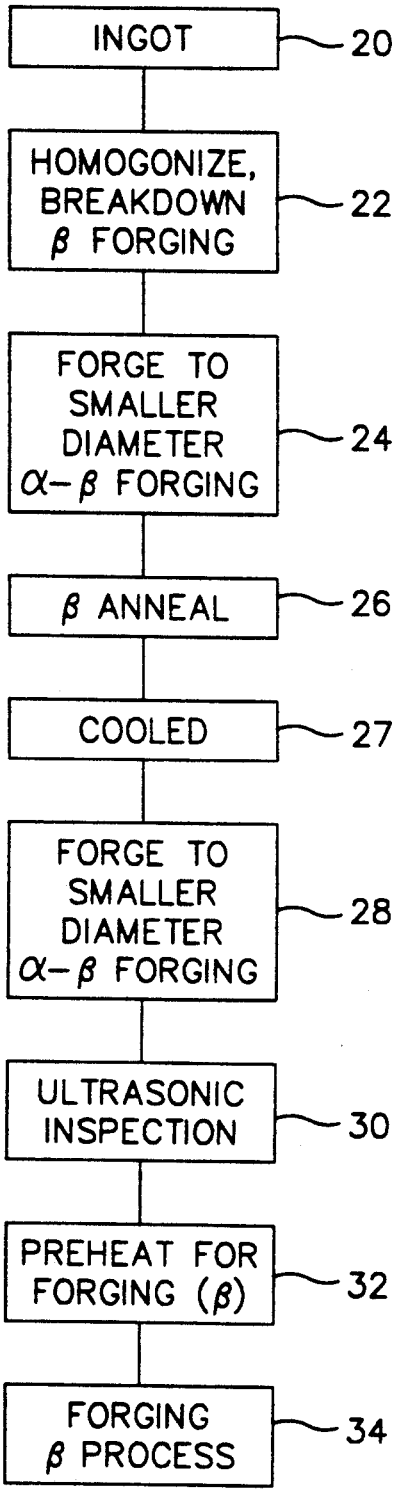
FIG. 2 is a block diagram of one representative commercial prior art manufacturing process for the reduction of a titanium alloy ingot to a billet, and then to a beta forged article.

FIG. 2 is a block diagram of a representative prior art commercial manufacturing process steps for the reduction of a titanium alloy ingot to a billet, and then to a forged article. There are many similar processes used-in current commercial practice. The illustrated process steps are applicable to widely available beta-stabilized alpha-beta alloys such as Ti-5Al-2Sn-2Zr-4Mo-4Cr, sometimes referred to as Ti-17, and Ti-6Al-2Sn-4Zr-6Mo, sometimes referred to as Ti-6246. In one form of these process steps, a 30-in diameter ingot 20 of Ti-17 is homogenized 22 at 2300°–2350° F. for at least 24 hours, then beta forged in the beta temperature range to about a 14-inch diameter. The beta transus of Ti-17 is about 1630° F. This forging operation may include redundant deformation, such as by upsetting and then forging to the desired billet shape, to refine the beta grain structure. The billet is then heated to about 1525° F. (in the alpha-beta temperature range) and alpha-beta forged 24 to about 10-inch diameter. The billet is then beta annealed 26 at about 1750° F. for about 2 hours, and fan air cooled 27. The billet is then heated to about 1525° F. and again alpha-beta forged 28 in the alpha-beta temperature range to a smaller final size, such as a 7-inch diameter. The billet is then inspected ultrasonically 30. It is then heated into the beta temperature range 32 in preparation for forging 34. The various forging steps, the process steps in FIGS. 3 and 4, and Examples 1 through 3 may be comprised of multiple steps as needed to produce a smaller diameter billet, with intermediate reheating operations included where needed.

Figure 3:
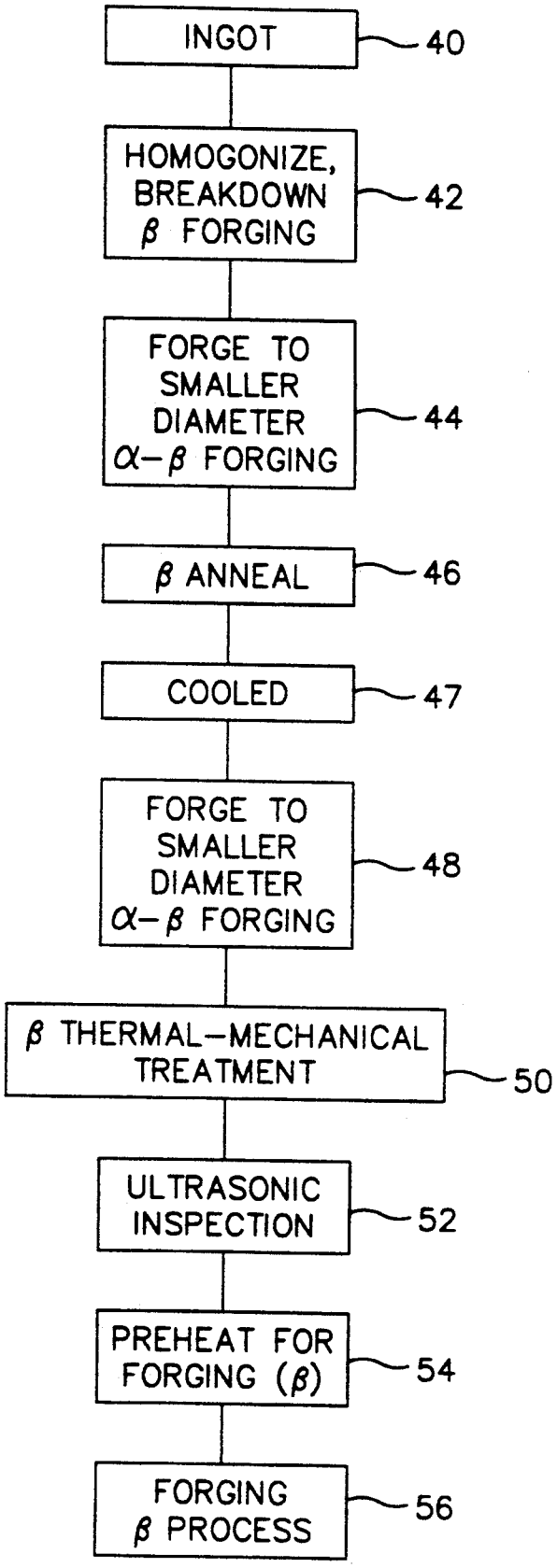
FIG. 3 is a block diagram of the process steps shown in FIG. 2, as modified to incorporate the process of the present invention.

FIG. 3 is a block diagram of the manufacturing process steps shown in FIG. 2, as modified to incorporate the process steps of the present invention. In this form, a 30-inch diameter ingot 40 of Ti-17 is homogenized 42 at 2300°-2350° F. for at least 24 hours, then forged in the beta temperature range to about 14-inch diameter. The billet is then heated to about 1525° F. (in the alpha-beta temperature range) and forged 44 to about 10-inch diameter. The billet is then beta annealed 46 at about 1750° F. for about 2 hours, and fan air cooled 47. The billet is then heated to about 1525° F. and alpha-beta forged 48 in the alpha-beta temperature range to a smaller final size, such as a 7-inch diameter. The billet then is given a thermomechanical treatment at a beta temperature 50, typically between the beta transus and about 175° F. above the beta transus; an aging treatment (not shown) may optionally follow the thermomechanical treatment, as required to reduce the amount of attenuation. The temperature of the thermomechanical treatment is preferably just enough above the beta transus to reliably achieve beta recrystallization within a reasonable time. Recognizing the problems associated with controlling industrial thermal treatment processes, about 25° F. to 50° F. above the beta transus should be considered the preferred temperature range for the thermomechanical treatment.

The billet is then inspected ultrasonically 52. It is then heated into the beta temperature range 54 in preparation for forging 56. Note that process steps 40, 42, 44, 46, 47 and 48 are identical to process steps 20, 22, 24, 26, 27 and 28, respectively, as illustrated in FIG. 2. Likewise, steps 52, 54 and 56 are identical to steps 30, 32 and 34, respectively, as illustrated in FIG. 2. In the context of the present invention, any process step identified as ultrasonic inspection includes whatever machining may be necessary to properly prepare the surface of a billet for ultrasonic inspection.

Figure 4:
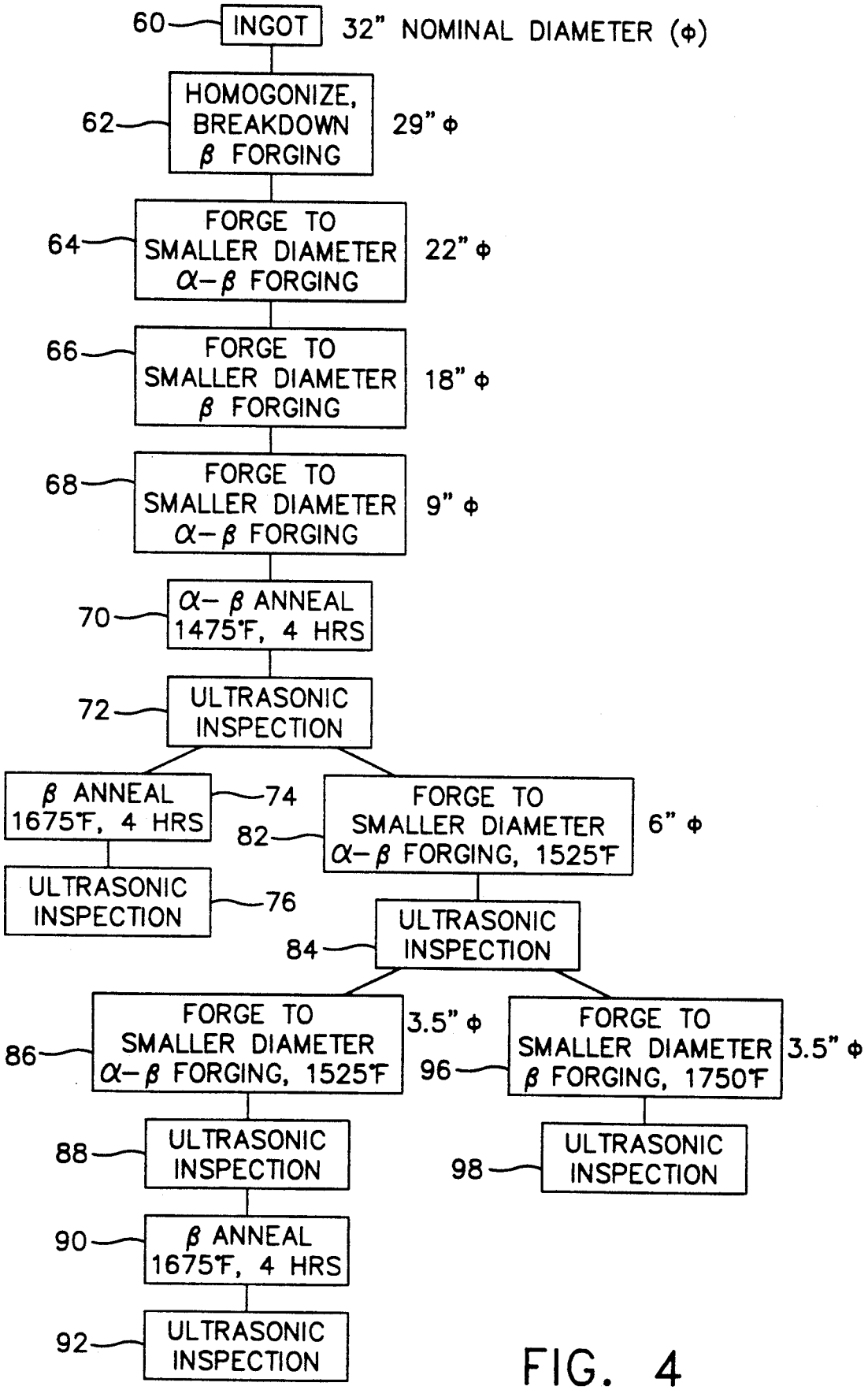
FIG. 4 is a block diagram of a manufacturing process steps for the reduction of a titanium alloy ingot to a billet; this process sequence incorporates several alternates designed to test the concepts of the present invention.

FIG. 4 is a block diagram of a special manufacturing process steps for the reduction of a titanium alloy ingot to a billet. This process sequence was developed specifically to test the concepts of the present invention. An ingot 60 of Ti-17 alloy is homogenized 62 at 2300°-2350° F., then forged in the beta temperature range to a smaller diameter. The billet is then heated to the alpha-beta temperature range and forged 64 to a smaller diameter. These steps are similar to steps 20, 22 and 24, respectively, of the process steps shown in FIG. 2. The billet is then forged to progressively smaller diameters in steps 66 and 68, first at a temperature above the beta transus, and then below the beta transus. The billet is then annealed at a temperature below the beta transus 70 and ultrasonically inspected 72. The billet is processed further through one of several alternate sequences. In one alternate sequence, the billet is given a thermomechanical treatment comprising an anneal 74 above the beta transus, at about 1675° F., for four hours, then given a second ultrasonic inspection 76 prior to forging operations. In a second alternate sequence, the billet is forged to a still smaller diameter below the beta transus 82, given an ultrasonic inspection 84, and further forged in a similar operation 86. The billet is then given another ultrasonic inspection 88, beta annealed 90 at about 1675° F., and then given a third ultrasonic inspection 92. In a third alternate sequence, the forged and ultrasonically inspected billet 84 is further forged 96 above the beta transus, then given an ultrasonic inspection 98. Each of the forging operations 64, 66, 68, 82, 86 and 96 is comprised of multiple forging steps, with intermediate reheating steps, as required. The ultrasonic inspection steps 72, 76, 84, 88, 92 and 98 are similar, except for modifications necessitated by differences in billet diameter.

During the development of the process of the present invention it was unexpectedly discovered that the response to ultrasonic inspection of beta-stabilized alpha-beta alloys and beta alloys is traceable to the prior beta grain structure of such alloys. This is directly contrary to what has been taught in the prior art, where the alpha grain structure has been accorded primary importance. However, the alloys on which the prior art research was done include Ti-6Al-4V (Ti-64) and other alloys which contain higher amounts of the alpha phase than beta-type alloys Ti-17 and Ti-6246. The process of the present invention is particularly effective for such beta and beta-type alloys. In retrospect, it is logical that the phase present in the larger amount should have primary importance in the response of a titanium alloy to ultrasonic inspection. The process of the present invention was applied to Ti-64 and Ti-6Al-2Sn-4Zr-2Mo (Ti-6242), and although some improvement in response to ultrasonic inspection was observed in the Ti-6242, it was less dramatic than was observed for Ti-17 and Ti-6246. To further describe the types of titanium alloys which represent a preferred usage for the present invention, those alloys having beta transus temperatures below about 1775° F. are particularly well suited to practice of the present invention.

As used herein, the term prior beta grain structure means that structure existing in a titanium alloy during thermomechanical treatment above the beta transus prior to cooling to below the beta transus temperature. Such a structure may result from beta recrystallization, or it may result from deformation at a temperature above the beta transus. However, the remaining beta grain size and the metallurgical structure produced by the transformation from the prior beta grain structure are related to the prior beta grain structure. What has been found to be most effective in improving the response of a beta-stabilized alpha-beta alloy or a beta alloy to ultrasonic inspection is a prior beta grain structure comprising a substantially equiaxed and substantially randomly oriented fine grain structure.

That prior beta grain structure may be obtained by beta recrystallizing a billet that has been deformed at a temperature below the beta transus, or by deforming a billet at a temperature above the beta transus, so that recrystallization occurs concurrently with deformation, or by some combination of such processes. The term thermomechanical treatment is used to encompass all of these alternate operations, and to encompass the step of subsequently cooling to ambient temperature. In any case, the amount of deformation must be sufficient to impart enough stored energy to the billet to cause recrystallization to occur. In the process steps illustrated in FIG. 3, the deformation in step 48 is preferably greater than about 40 percent reduction in cross sectional area. The preferred mode of the invention comprises beta recrystallization without concurrent deformation, because such a process minimizes disruption to commercial processes for producing titanium alloy billets. The grain size in the preferred prior beta grain structure is as small as can be achieved. It was found that the noise resulting from grain boundary scattering is minimized by small grain size, as is generally recognized in the art. The preferred mode of the invention also includes a prior beta grain structure that has a minimum amount of texturing and a minimum amount of grain anisotropy. The amount of deformation below the beta transus prior to beta recrystallization in step 48, and the temperature of the beta recrystallization and the amount of deformation, if any, comprising step 50 must therefore be selected accordingly.

Allison et al. showed that ultrasonic attenuation in the axial direction of Ti-64 specimens could be reduced by a process sequence of quenching from either a beta heat treatment or an alpha-beta heat treatment (the latter was preferred) and then aging. Aging at about 1200° F. for about 2 hours was most effective. Even though there are significant differences between the experiments described by Allison et al. and those of the present invention, it was found that a quench-and-age cycle provided some reduction in attenuation in the process of the present invention, as described in the Examples presented herein. Thus, the addition of an aging cycle is considered a preferred form of the present invention for those applications where the size of the billet or other considerations require minimizing the characteristic attenuation of the titanium alloy.

EXAMPLE 1

A billet of Ti-17 was processed in accordance with the procedure illustrated in FIG. 4. One portion was processed through steps 60 through 76. The thermomechanical treatment in step 74 consisted of annealing at 1675° F. for four hours, followed by air cooling. A second portion of the billet was processed through steps 60 through 72 and steps 82 through 92. A third portion of the billet was processed through steps 60 through 72, and steps 82, 84, 96 and 98. Comparing the noise observed in ultrasonic inspections before and after several process steps provided the following results, where the indicated reduction in noise was attributed, at least in part, to the indicated thermomechanical process. However, some reduction in noise is typically observed simply, as a result of reducing the diameter of a billet, so that some portion of the reduction in noise associated with the forging processes might be attributed to reduction in diameter.

| Process Step | Thermomechanical Process | Reduction in Noise | Minimum Resolvable Size Ratio |
|---|---|---|---|
| 74 | $\beta$ anneal | 9 db | 0.35 |
| 82 | $\alpha + \beta$ forging | no change | 1.00 |
| 86 | $\alpha + \beta$ forging | 2 db | 0.79 |
| 90 | $\beta$ anneal | 9 db | 0.35 |
| 96 | $\beta$ forging | 11 db | 0.28 |

From these data it was concluded that thermomechanical treatment above the beta transus effectively reduced noise in ultrasonic inspection, while forging below the beta transus did not. The extent to which reduced ultrasonic noise permits detection of smaller imperfections is indicated in the preceding table. For example, the cross sectional area of the minimum resolvable size imperfection after the beta anneal of process step 74 is only 0.35 times the cross sectional area of the minimum resolvable size imperfection prior to the beta anneal, all other factors, such as depth of the imperfection below the surface, shape of the imperfection, etc., being equal.

From other tests related to this Example it was concluded that the amount of deformation in step 82 or step 86 is preferably limited to about 25 percent reduction in area, to keep texturing and grain anisotropy within acceptable values. Also, the preferred cooling rate from thermomechanical treatment above the beta transus was found to be water quenching, followed by aging at about 1200° F.

EXAMPLE 2

A billet of Ti-17 was processed in accordance with the procedure illustrated in FIG. 3. The billet was reduced in cross sectional area by about 30 percent in step 48. The billet was given two ultrasonic inspections, the first between steps 48 and 50, and the second in step 52. The thermomechanical treatment of step 50 comprised beta annealing at about 1680° F. for one hour, followed by cooling in air to ambient temperature. It was found that the noise measured in the ultrasonic tests before and after the thermomechanical treatment of step 50 was reduced 6 db by the beta recrystallization. However, the attenuation was worsened by 6 db. From this example it was concluded that the amount of deformation in step 48 is preferably greater than 30 percent reduction in cross sectional area.

EXAMPLE 3

A billet of Ti-17 was processed in accordance with the procedure illustrated in FIG. 3. This billet was reduced in cross sectional area by about 50 percent in step 48. The billet was given two ultrasonic inspections, the first between steps 48 and 50, and the second in step 52. The thermomechanical treatment of step 50 comprised beta annealing at about 1700° F. for one hour, followed by water quenching and aging at 1200° F. for eight hours, and air cooling to ambient temperature. It was found that the noise measured in the ultrasonic tests before and after the thermomechanical treatment of step 50 was reduced 13 db by the beta recrystallization. However, the attenuation was worsened by only 5 db, resulting in a net improvement of 8 db.

The billets produced under the conditions of Example 1 and the conditions of Example 2 provided finished forgings having substantially the same mechanical properties as billets produced using the conventional process illustrated in FIG. 2. The thermomechanical treatment of the present invention caused no adverse effect on mechanical properties.

In light of the foregoing discussion, it will be apparent to those skilled in the art that the present invention is not limited to the embodiments, methods and compositions herein described. Numerous modifications, changes, substitutions and equivalents will become apparent to those skilled in the art, all of which fall within the scope contemplated by the invention.

We claim:

1. A process for manufacturing a titanium alloy article comprising the steps of:

selecting a titanium alloy from the group of alloys consisting of beta titanium alloys and beta-stabilized alpha-beta titanium alloys, the alloy having a beta transus temperature;

forming an ingot from the alloy;

homogenizing the ingot at a temperature above the beta transus temperature for the alloy and beta breakdown forging the ingot at a temperature above the beta transus of the alloy;

then reducing the ingot by alpha-beta forging at a temperature below the beta transus temperature of the alloy; then thermomechanically treating the billet to beta recrystallize the billet in order to reduce the grain size and substantially eliminate texture, thereby providing improved response for ultrasonic inspection; then cooling to ambient temperature; then ultrasonically inspecting the billet for imperfections and evaluating imperfections immediately following the thermomechanical treatment; then reheating the billet to a forging temperature; and forging the billet to form an article having the desired microstructure.

2. The process of claim 1, further including a step for alpha-beta forging the billet at a temperature below the beta transus temperature of the alloy.

3. The process of claim 1, wherein the forging temperature is above the beta transus temperature of the alloy.

4. The process of claim 3, wherein the recrystallizing step includes a thermomechanical treatment, conducted at a temperature between the beta transus temperature of the alloy and about 75° F. above the beta transus temperature of the alloy.

5. The process of claim 4, wherein the thermomechanical treatment includes deformation of the billet above the beta transus.

6. The process of claim 4, wherein the thermomechanical treatment additionally includes aging at a temperature between about 1000° F. and about 1400° F.

* * * * *